US007226954B2

(12) United States Patent
Tavasoli et al.

(10) Patent No.: US 7,226,954 B2
(45) Date of Patent: Jun. 5, 2007

(54) INTEGRATED PROCESS AND APPARATUS FOR PRODUCING LIQUID FUELS

(75) Inventors: Ahmad Tavasoli, Tehran (IR); Ali Karimi, Tehran (IR); Kambiz Sadagiani Zadeh, Tehran (IR); Abas Ali Kodadadi, Tehran (IR); Yadollah Mortazavi, Tehran (IR); Shahram Sharifnia, Kermanshah (IR)

(73) Assignee: Research Institute Petroleum Industry (RIPI), Tehran (IR)

( * ) Notice: Subject to any disclaimer, the term of this patent is extended or adjusted under 35 U.S.C. 154(b) by 0 days.

(21) Appl. No.: 11/242,726

(22) Filed: Oct. 3, 2005

(65) Prior Publication Data

US 2006/0079586 A1 Apr. 13, 2006

(30) Foreign Application Priority Data

Oct. 1, 2004 (EP) ..... 04104831

(51) Int. Cl.
*C07C 27/00* (2006.01)

(52) U.S. Cl. ..... 518/707; 518/706; 518/715; 518/717

(58) Field of Classification Search ..... 518/706, 518/707, 715, 717
See application file for complete search history.

(56) References Cited

U.S. PATENT DOCUMENTS

| | | | |
|---|---|---|---|
| 2,149,515 | A | 3/1939 | Fischer |
| 6,331,573 | B1 | 12/2001 | Kibby |
| 2003/0217249 | A1 | 11/2003 | Postiff et al. |

FOREIGN PATENT DOCUMENTS

| | | |
|---|---|---|
| GB | 515 037 | 11/1939 |
| GB | 631 682 | 11/1949 |

*Primary Examiner*—J. Parsa

(74) *Attorney, Agent, or Firm*—Kenyon & Kenyon LLP

(57) ABSTRACT

The invention relates to an integrated process for producing liquid fuels, the process comprising the steps of:
a) subjecting syngas with a hydrogen/carbon monoxide ratio between about 0.5 to 2.0 to Fischer-Tropsch reaction conditions in the presence of a first catalyst;
b) optionally removing water and/or heavy hydrocarbons from the product stream; and
c) subjecting the product from step a) or b) together with syngas of a hydrogen/carbon monoxide ratio higher than that of step a) or hydrogen to Fischer-Tropsch reaction conditions at higher temperatures than during step a) in the presence of a second catalyst, said second catalyst being selected such as to provide a higher activity than said first catalyst; wherein said first catalyst is selected such as to provide low methane selectivity and high olefins and heavy hydrocarbons selectivity. According to the invention, a third synthesis step or additional synthesis steps is added subsequent to the synthesis step c).

13 Claims, 4 Drawing Sheets

INTEGRATED PROCESS AND APPARATUS FOR PRODUCING LIQUID FUELS

CROSS-REFERENCE TO RELATED APPLICATIONS

This application claims the benefit of European patent application Serial Number 04104831.5, filed Oct. 1, 2004, the contents of which is incorporated herein by reference.

FIELD OF INVENTION

The present invention relates in general to gas to liquid conversion (GTL) and relates in particular to an integrated process and apparatus for producing liquid fuels, more particularly to an integrated multi-stage process and apparatus for producing liquid fuels.

BACKGROUND ART

Huge natural gas resources economically not viable for transportation to remote markets, diminishing limited oil resources, and increasing demand for clean fuels make the development of natural gas to liquid fuels conversion inevitable. Fischer-Tropsch synthesis (hereinafter: FT synthesis) is the most viable method for converting natural gas to liquid fuels. In this process, the natural gas is first converted to syngas by steam reforming and/or partial oxidation. Then the syngas is converted to long chain hydrocarbons, in the presence of cobalt-based or iron-based catalysts. The economy of the gas to liquid conversion process depends an the capital investment on the process, and more importantly on the average cost of the products. The production of syngas is the most expensive step in the conversion of natural gas to liquid fuels. Therefore, the Fischer-Tropsch process should be performed with the highest yield possible.

Depending an the operation conditions and composition of the catalysts used, the products range from $C_1$ to $C_{40}$ hydrocarbons. Methane and light gaseous hydrocarbons are undesirable products of FT synthesis and their recycle and conversion to syngas is costly. On the other hand, the heavy waxes also require hydro-cracking to middle distillates. Hydro-cracking results in more light gases. $C_{5+}$ (weight fraction of pentane and heavier hydrocarbons) hydrocarbons, particularly middle distillates, need to be maximized. Many research efforts have focused an catalyst compositions, reactor systems, and operating conditions to improve the FT synthesis selectivity.

Production of significant amounts of methane, light gaseous hydrocarbons, and heavy waxes are of the major selectivity problem of the FT synthesis. By addition of proper promoters to the structure of the catalysts, researchers have tried to decrease methane selectivity, i.e., the yield of methane during FT-synthesis. Different transition metals, such as Ru, Re, Pt, Pd and Rh, alkaline metals, and rare earth oxides have been used to improve FT-synthesis activity and/or selectivity. Such promoters can decrease methane selectivity, increase the chain growth probability and enhance the yield of heavy waxes. Some other investigators have added α-olefins to FT synthesis reactor feed, to reduce the yield of methane and other light gaseous hydrocarbons. The major drawback of this method is separation of the α-olefins from the products to be recycled to the feed. Furthermore, one of the major problems of FT synthesis at high CO conversions is deactivation of the catalysts by oxidation and strong metal-support interactions in the presence of high partial pressures of water and also catalysts coking that are not resolved yet.

A two-stage apparatus for FT-synthesis has been proposed recently in U.S. Pat. No. 6,331,573 B1 and US 2002/0151605 A1. The first stage of FT-synthesis is performed using conditions in which chain growth probabilities are relatively low to moderate and the product of the reaction includes a relatively high proportion of low molecular weight olefins ($C_2$–$C_8$ olefins) and a relatively low proportion of high molecular weight waxes ($C_{30+}$). The product from the first stage is fed into a second stage where the chain growth probabilities are relatively high. The temperatures of the first stage are higher than that of the second stage. Under these conditions wax and other paraffins produced in the first stage are relatively inert. Light olefins compete with heavier olefins for chain initiation to initiate fewer chains at $C_{20+}$ so that a relatively large fraction in the $C_{5-12}$ range is produced. In the first stage an iron-containing catalyst is used whereas in the second stage a cobalt-containing catalyst is used.

A high CO conversion ratio in the first stage may cause problems with deactivation of the catalysts in the first stage by oxidation and strong metal-support interactions and with high partial pressures of water. Furthermore, coking of the catalysts may cause serious problems.

GB 631 682 A discloses a two-stage process for synthesizing liquid fuels, wherein a mixture containing carbon monoxide and hydrogen is fed to a first reaction zone and wherein a feed mixture comprising the gaseous fraction from the first reaction zone and containing a ratio of hydrogen to carbon monoxide higher than that in the mixture fed to the first reaction zone is charged to a subsequent second reaction zone and wherein liquid products formed in the second reaction zone are recovered. In both stages water is intentionally added to promote the water gas shift reaction. The gaseous products of both stages are mixed and returned back to the first stage. The gases react in the two reaction zones at elevated temperatures of above 310° C.

U.S. Pat. No. 2,149,515 disclosed a multi-stage process for synthesizing liquid fuels, wherein one type of catalyst is used in all stages. This makes minimizing the yield of heavy waxed difficult. Use of three stages is not disclosed.

GB 515 037 A discloses a two-stage process for synthesizing liquid fuels with a focus on the production of mostly olefins. In this process the gases react substantially at atmospheric pressures, namely in the range between 0 and 10 atm. Products from the first stage are not separated before being charged to the second stage. An iron-based catalyst is used in the second stage.

SUMMARY OF THE INVENTION

It is an object of the present invention to provide a process and an apparatus for producing liquid fuels using Fischer-Tropsch reaction conditions with improved selectivity and enhanced catalyst lifetime. According to another aspect of the present invention a process and an apparatus for producing liquid fuels using Fischer-Tropsch reaction conditions is to be provided enabling producing liquid fuels in a more efficient and economical manner.

The above and further objects are solved by an integrated process for producing liquid fuels. An integrated process for producing liquid fuels according to the present inventions comprises the steps of: subjecting syngas with a hydrogen/carbon monoxide ratio between about 0.5 to 2.0 to Fischer-Tropsch reaction conditions in the presence of a first catalyst; optionally re-moving water and/or heavy hydrocarbons from the product stream; and subjecting the product from the first stage or optionally after removing water and/or heavy hydrocarbons from the product stream together with syngas of a hydrogen/carbon monoxide ratio higher than that of the first stage or hydrogen to Fischer-Tropsch reaction conditions at higher temperatures than during the first stage in the presence of a second catalyst, said second catalyst being selected such as to provide a higher activity than said first catalyst. According to the present invention the first catalyst is selected such as to provide low methane selectivity and high olefins and heavy hydrocarbons selectivity.

Partial removal of water and/or heavy hydrocarbons from the products streams of the stages reduces problems caused by oxidation and strong metal-support interactions due to the high partial pressures of water and coking of catalysts is reduced efficiently.

In another embodiment according to the present invention the second catalyst is selected as to be more active than the first catalyst and the first catalyst is selected as to be more selective (very low methane selectivity and very high olefin and heavy hydrocarbon selectivity) than said second catalyst. Thus, methane selectivity of the process can be decreased and heavy hydrocarbons selectivity of the can be increased even more, thus further increasing efficiency of the process.

Experiments of the inventors revealed that most of the methane formed in the course of a conventional two-stage FT-Synthesis process is formed at the beginning of the catalyst bed. Thus, if a conventional catalyst that is selective to methane formation (e.g. Iron catalyst) is used at the first stage it tends to intensify methane formation. Furthermore, conventional Iron catalysts are more selective for β-olefins formation. β-olefins weekly participate in secondary reactions which in turn lead to chain growth and are forming higher molecular weight products. Thus, the disadvantages of a conventional two-stage FT-Synthesis as disclosed e.g. by U.S. Pat. No. 6,331,573 B1 are overcome according to the present invention.

In another embodiment according to the present invention the first catalyst has an alpha value of about 0.8 to 0.98 and said second catalyst has an alpha value of about 0.8 to 0.95.

More specifically, according to the above embodiments the carbon monoxide conversion in the first FT stage can be in the range between about 10% and about 40% and the carbon monoxide conversion in the second stage can be in the range between about 40% and about 95%.

In another embodiment according to the present invention, a heavy liquid fraction, e.g. a $C_{9+}$ fraction, is isolated after the first stage and before the second stage. Thus, production of heavier hydrocarbons and waxes is reduced further. Furthermore, problems due to coking of catalysts can be reduced further.

Thus, according to the above embodiments the product of the first stage in the $C_{2-8}$ range may include about 75% olefins by weight.

Thus, according to the present invention, by performing the above two-stage or multi-stage FT-synthesis, the light gases are reduced by about 10% to about 40% as compared to a FT-synthesis performed in a single stage at the conditions of the first step. Furthermore, according to the present invention, by performing the above two-stage or multi-stage FT-synthesis, the distillate selectivity is enhanced by about 10% to about 40% as compared to a FT-synthesis performed in a single stage at the conditions of the first step. Furthermore, according to the present invention, by performing the above two-stage or multi-stage FT-synthesis, the catalysts life is increased by about 30% to about 100% as compared to a FT-synthesis per-formed in a single stage at the conditions of the first step.

According to another embodiment of the present invention the first catalyst comprises cobalt. As is well-known in the prior art, cobalt-containing catalysts provide relatively high chain growth probabilities, which had a limiting effect on the lifetime of catalysts in the prior art, e.g. due to high partial pressures of water during FT-synthesis. Cobalt-containing catalysts have not used beforehand in two-stage FT-synthesis or multistage FT-synthesis. According to the present invention, however, the combination of the above-mentioned first catalyst with a second catalyst having a suitable chain growth probability results in an even more economical FT-synthesis.

The first catalyst, which is containing cobalt, is preferably promoted with alkali metal oxides. In such embodiments the first catalyst may comprise 10% wt. to 50% wt. of cobalt, wherein the atomic ratio of the alkali metal to cobalt is about 0.01 to 0.1.

For compensating for the reduction in the activity of alkali promoted catalysts, according to another embodiment of the present invention 0.1% wt. to 3% wt. of noble metals can be added to the first catalyst.

According to a further embodiment also the second catalyst comprises cobalt. For enabling a higher activity and suitable chain growth probability parameters during the second and all optional subsequent stages of FT-synthesis, the second catalyst can be promoted with ruthenium. An additional advantage is that Ruthenium is also more selective towards heavier hydrocarbons.

More specifically, according to a further embodiment the second catalyst may comprise 10% wt. to 60% wt. of cobalt and 0.1% wt. to 3% wt. of ruthenium. A lanthanide oxide can be added to the second catalyst in an amount of 1% to 5% by total weight of the catalysts.

While the process has been described above as a two-stage FT-synthesis process, the process according to the present invention is not limited to two-stage FT-synthesis processes. A third or optionally even more synthesis stages may be added as suitable for achieving optimum process conditions.

According to another preferred embodiment of the present invention the process further comprises a third step of subjecting syngas together with the product from the above two-stage FT-synthesis to Fischer-Tropsch reaction conditions in the presence of a third catalyst. In such an exemplary embodiment for a 3-stage FT-synthesis, the following further steps may be provided: removing water and/or liquid hydrocarbons from the product stream of the second stage; and subjecting the product from the second stage or from the above step of removing water and/or liquid hydrocarbons together with syngas to Fischer-Tropsch reaction conditions in the presence of a third catalyst, said third catalyst being selected such as to provide a higher activity than at least said first catalyst Adding a third stage to the above two-stage FT-synthesis enables an even more efficient selection of methane selectivity and olefins and high hydrocarbons selectivity in the first and/or second stage of the FT-synthesis according to the present invention.

According to another embodiment, the second catalyst and the third catalyst are identical. According to another embodiment the hydrogen/carbon monoxide ratio of the syngas in the third stage is highest and higher than in the first and second stage.

According to another embodiment syngas is injected during the second stage and/or the third stage at lower pressures than during the first stage. The higher pressure in the first stage helps to inhibit the formation of methane even more efficiently.

According to another embodiment, the temperature is increasing from the first stage to the second stage or, in a multi-stage FT-synthesis process according to the present invention, from the first stage to the last stage. Furthermore, in a multi-stage FT-synthesis according to the present invention, hydrogen to be injected between the individual stages is distributed along the stages (or reactors) following the first stage (or reactor).

According to a further embodiment the first catalyst is reduced at temperatures in the range between 300° C. and 500° C. before performing FT-synthesis in the above first stage. According to another embodiment, an apparatus for performing an integrated process for producing liquid fuels is provided, said apparatus comprising: a first reactor, wherein syngas with a hydrogen/carbon monoxide ratio between about 0.5 to 2.0 is subjected to Fischer-Tropsch reaction conditions in the presence of a first catalyst; a device for removing water and/or heavy hydrocarbons from the product stream of the first reactor; a second reactor configured to subject the product from the first reactor or the device for removing water and/or heavy hydrocarbons together with syngas of a hydrogen/carbon monoxide ratio higher than that used in the first reactor or hydrogen to Fischer-Tropsch reaction conditions at higher temperatures than in the first reactor in the presence of a second catalyst, said second catalyst providing a higher activity than said first catalyst; wherein said first catalyst is selected such as to provide low methane selectivity and high olefins and heavy hydrocarbons selectivity.

According to another embodiment the apparatus according to the present invention may further comprise: a third reactor for subjecting the product from the second stage together with syngas to Fischer-Tropsch reaction conditions in the presence of a third catalyst, said third catalyst being selected such as to provide a higher activity at least than said first catalyst, preferably to provide a higher activity than both the first catalyst and the second catalyst. In such an embodiment a second device for removing water and/or liquid hydrocarbons from the product stream of the second reactor may be provided for reducing the partial pressure of water and increasing catalyst lifetime.

By distributing the catalysts and syngases, both with different compositions, along a fixed-bed reactor and/or different slurry bubble column reactors, the FT synthesis selectivity to distillates will be improved according to the present invention, Furthermore, the catalyst lifetime will be enhanced.

BRIEF DESCRIPTION OF DRAWINGS

The above and further advantages, features and objects will become more apparent from the following detailed description of preferred embodiments referring to the accompanying drawings, wherein.

DETAILED DESCRIPTION OF PREFERRED EMBODIMENTS

Figure 1:
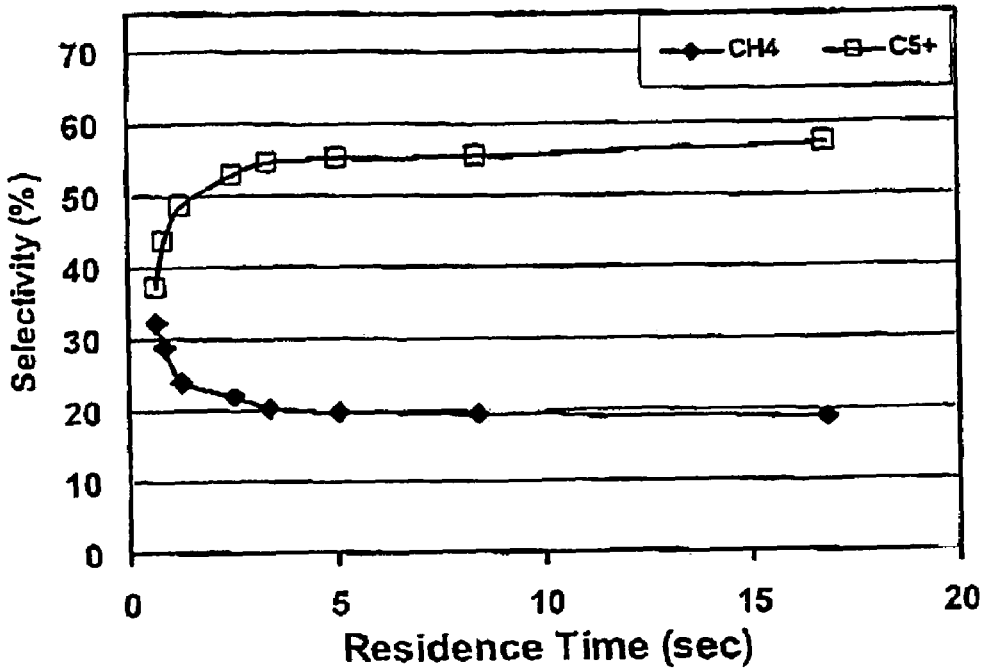
FIG. 1 is a diagram showing the changes in $CH_4$ and $C_{5+}$ selectivity with residence time.

The present invention is directed to an integrated process for producing liquid fuels from syngas. As used herein, the term "integrated process" refers to a process comprising a sequence of steps, some of which may be parallel to other steps in the process, but which are interrelated or somehow dependent upon either earlier or later steps in the total process.

The process described herein includes a Fischer-Tropsch reaction comprising at least two stages. According to a preferred embodiment explained below in more detail, the Fischer-Tropsch reaction is performed in three stages. However, the present application shall not be limited to use of these three stages, but may be extended to a multi-stage FT-synthesis easily, as will become apparent to a person skilled in the art.

The first stage of the Fischer-Tropsch chemistry is performed using conditions in which the first catalyst provides a low methane selectivity and a high olefins and heavy hydrocarbons selectivity. Accordingly, in the first stage the chain growth probabilities are relatively high, and the product of the reaction includes a relatively high proportion of medium molecular ($C_{2-8}$) weight olefins but a relatively low proportion of high molecular weight ($C_{30+}$) waxes. For example, catalysts with alpha values between about 0.7 and 0.95 provide a relatively high proportion of medium molecular weight olefins but a relatively low amount of wax, i.e., less than about 10% by weight.

The products of the first stage are fed into the second stage where the activity of the second catalyst is higher than that of the first catalyst. For example, catalysts with an alpha value above about 0.85, and preferably, above about 0.9 are used in the second stage. As a general rule, as the alpha value of the catalyst increases, the amount of methane production decreases.

According to the present invention, optionally further FT fraction stages can be provided.

Using the process described herein, most chains in the second stage of the Fischer-Tropsch process are initiated at $C_{2-8}$, resulting in moderate to high chain growth probability which produces a relatively larger fraction in the $C_{5-20}$ range. In this manner, wax yield is minimized.

One of the benefits of performing the two-stage Fischer-Tropsch reaction is that the use of a hydrocracking processes can be minimized or, ideally, eliminated altogether.

Catalyst Selection

First Stage of FT-Synthesis

Any catalyst having low methane and light gaseous hydrocarbon and high a-olefins selectivity can be used in the first part. The chain growth parameter of this catalyst is high. The olefin to paraffin ratio in the overall product of this catalyst is 0.2–2.0. The preferred catalyst for the first part is a cobalt catalyst promoted with alkali metal oxides. The oxides can be potassium, sodium or cesium. The weight percentage of cobalt in this catalyst is 10–50 and the atomic ratio of the alkali metal to cobalt is 0.01–0.1.

As is well known in the prior art, the type of support used can influence methane production. Suitable metal oxide supports or matrices which can be used to minimize methane production include alumina, titania, silica, magnesium oxide, alkaline earth titanates, alkali titanates, rare earth titanates and mixtures thereof.

Titania or titania-containing supports provide lower methane production than, for example silica, alumina or manganese oxide supports. Accordingly, a preferred catalyst support in the first stage is titania containing γ-alumina.

To compensate for the reduction in the activity of alkali promoted catalyst, 0.1–3 wt % of noble metals can be added to the catalyst. 1–5 wt % of the catalyst can be lanthanide or actinide oxides. This catalyst should be reduced at 300–500° C. in a flow of reducing gases, prior to FTS.

Second and Subsequent Stages

Catalysts with higher activity and suitable chain growth probability parameters are used in the following parts. A cobalt catalyst having a ruthenium promoter is preferably used. Experiments conducted by the inventor show that the ruthenium promoter makes the catalyst 2.5 to 3 times more active. Ruthenium is also more selective towards the heavier hydrocarbons. The amount of cobalt in this catalyst is 10–60 wt %. The amount of ruthenium is 0.1–3 wt %. A lanthanide oxide is added in an amount of 1–5 percent by the total weight of the catalyst. The γ-alumina support with specific surface area of 150–250 $m^2$/gr and a porosity of 0.4–0.9 ml/gr are used.

The Synthesis Gas

A syngas with low $H_2$/CO ratio of about 0.5–2.0 is used in the first part of the reactor. The syngas added to the following parts has higher $H_2$/CO ratios up to 3 at the last parts. Adding hydrogen or syngas with high $H_2$/CO to the parts following the first part can perform the changes in the syngas compositions. In general, hydrogen is distributed along the reactors following the first reactor.

Operation Conditions

The temperature of the first FTS reactor part is about 180–220° C. The following reactors are held at higher temperatures of 200–250° C. The pressure of the reactors is in the range of 10–40 bars. The conversion of carbon monoxide in the first reactor is in the range of 10–40%. The products of the first reactor can be cooled down to condense water and heavy products and lighter hydrocarbons along with unconverted reactants are injected to the second reactor of the system. The carbon monoxide conversion is up to 40–95% in the second reactor. In the following reactor(s), the conversion of carbon monoxide in-creases up to 97%. The condensation of the water and heavy products can be performed between different reactors.

The methane of multi-stage reactor is 10–50% less than that of the single-stage FTS systems. The selectivity of $C_{5-20}$ liquid products in the process of this invention is 10–40% more than the single-stage process. The methane of multi-stage reactor system is 10–50% less than that of the single-stage FTS-systems. The selectivity of $C_{5-20}$ liquid products in the process of this invention is 10–40% more than the single-stage process.

The Lifetime of the Catalyst

The water and heavy products among different parts of the reactor(s) are condensed and separated from the parts effluents. In this way, the catalyst lifetime increases by up to 50%. The water is the main cause of oxidation of active metals of the catalyst and its interaction with the support. This effect is more pronounced for FTS at high conversions of carbon monoxide, in which high partial pressures of water is formed.

EXAMPLE

In the following, we propose a Fischer-Tropsch synthesis (FTS) process for producing liquid fuels from synthesis gas via distribution of FTS catalysts and syngases in fixed-bed reactors (FBR) and/or stages of slurry bubble column reactors (SBR). Numerous parameters affect the selectivity of FTS. One of the most important parameters is the composition of the catalyst. Cobalt is usually used for Gas-to-Liquid processes, due to its higher chain growth probability. However, other additives such as alkali metals, noble metals and rare earth oxides improve the activity, selectivity, and/or stability of the catalysts. Alkali-metal promoted catalysts have lower methane selectivity, however their activity is also lower.

In addition $H_2$/CO ratio and temperature strongly change the selectivity of FTS on a specified catalyst. It is well established that lower temperatures enhance the chain growth probability towards more desirable heavier hydrocarbons. FT synthesis rates are often assumed to be proportional to $H_2$ concentration and independent or small negative order in CO concentration at conditions of interest. The order of hydrogen concentration in the reaction rate for paraffin products is higher than that for olefins. Higher $H_2$/CO ratios favor the formation of methane and reduce the selectivity to higher molecular weight hydrocarbons. Also in the kinetics expressions, which are specific to each hydrocarbon product, the order of CO concentration tends to become increasingly negative for lighter hydrocarbons.

As a result, any decrease in CO concentration favors the formation of lighter FT synthesis products. All the results emphasize the crucial effect of hydrogen an FT synthesis CO conversion rate and, particularly, products distribution.

It is also well known that adding olefins to the feed increases liquid $C_{5+}$ yield in the FTS. Preferred olefins useful in the process are a-olefins of the type R—CH═$CH_2$ wherein R is hydrogen or an alkyl group having about 1 to 10 carbon atoms. These 1-alkenes can compete with carbon monoxide and heavier olefins for readsorption and chain initiation. Also they can add directly to the growing chains. These secondary reactions can strongly influence product selectivity.

FIG. 1 shows the dependency of the selectivity for methane and $C_5$+ hydrocarbons on the residence time in a FT reactor. As can be seen in FIG. 1, the $CH_4$ selectivity sharply decreases as the feed bed residence time increases up to about 3.5 sec, then the curve levels off. At the same time, the $C_{5+}$ selectivity sharply increases to about the same value for residence time, and then it levels off. The results show that methane is produced mainly at the very beginning of the catalytic bed. Hence, it seems that, using a catalyst with low methane selectivity at the regions close to the bed entrance lowers methane selectivity in the final products. Therefore, according to the present invention a catalyst with low methane and high olefins and heavy hydrocarbons selectivity is used in the first part of FBR and/or stages of SBR's. The products of this stage are cooled down to condense water and heavy hydrocarbons and the remaining gas is injected to the second stage reactor(s) together with a syngas, $H_2$/CO ratio of which can be higher than the syngas fed to the first part of FBR and/or stage of SBR's. In the second part of FBR and/or stage of SBR's, a catalyst with higher activity is used. Olefins with a low molecular weight ($C_2$–$C_8$) from the first part be readsorbed in the following parts and undergo further reactions, especially incorporation and growth to heavier hydrocarbons.

Figure 2:
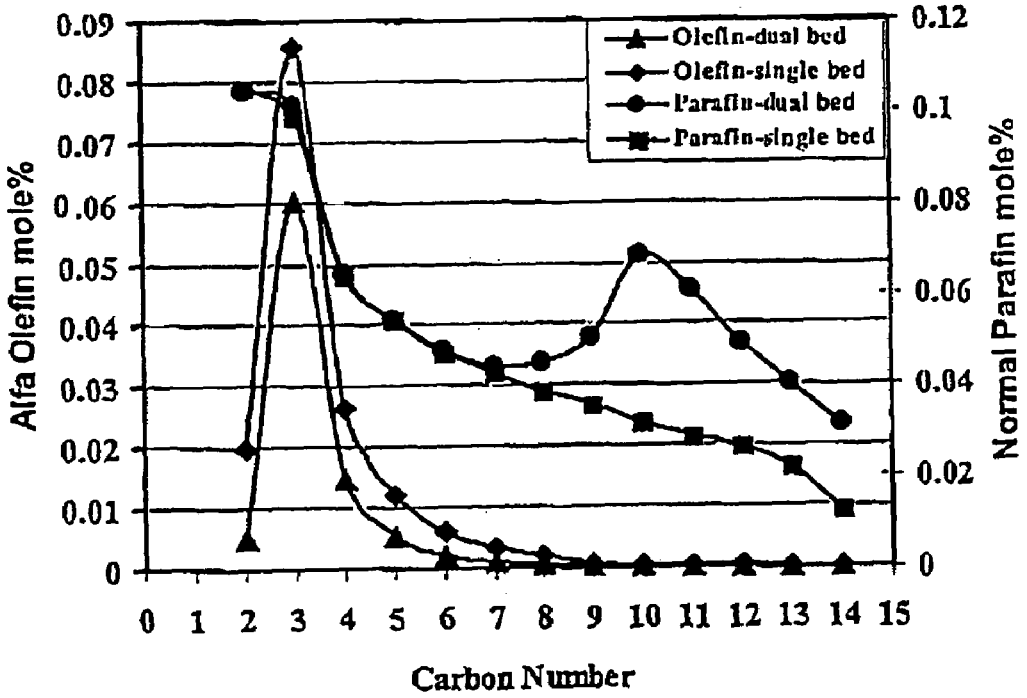
FIG. 2 is a diagram comparing the production rates of n-paraffins and a-olefins in the range of $C_2$–$C_{14}$ hydrocarbons.

In a series of experiments, two catalysts with different compositions were charged in two parts of a FBR and the results compared with the same reactor filled with the catalysts uniformly mixed. FIG. 2 compares the production rates of n-paraffins and a-olefins in the range of $C_2$–$C_{14}$ hydrocarbons. The paraffin content in the products of single bed reactor decreases as carbon number increases. The same trend can be seen for a-olefins except $C_3$. Comparing the production rates of $C_2$–$C_{14}$ a-olefins in the two systems, the mole % of a-olefins in the products of the dual bed reactor is about 40–100% less than that of a single bed reactor. The mole % of $C_2$–$C_7$ paraffins in the products is the same for both systems, but the production rate of the $C_{8+}$ paraffins increases significantly in the dual bed system. The data show that the increasing $C_{8+}$ paraffin content arises predominantly from the net disappearance of $C_2$–$C_7$ α-olefins. $C_2$–$C_7$ α-olefins production rate decreases in the dual bed system without a corresponding increase in $C_2$–$C_7$ n-paraffin's, leading to a net increase in the fraction of the converted CO that appears as $C_{8+}$. The observed increase in the $C_{8+}$ n-paraffins actually results from the combined effects of enhanced readsorption of $C_2$–$C_7$α-olefins in the dual bed system.

Figure 3:
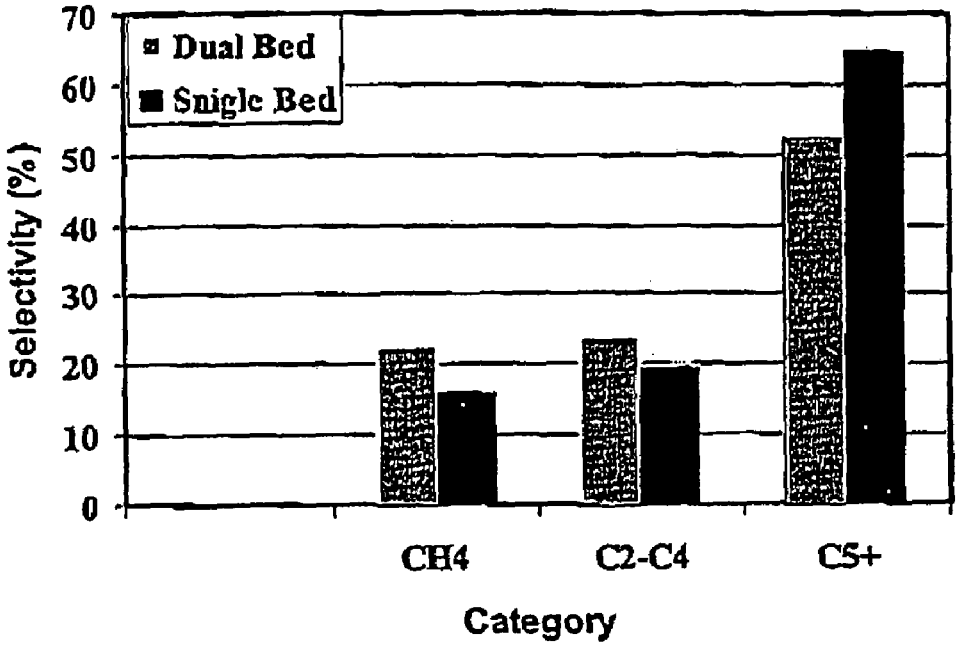
FIG. 3 is a schematic diagram for comparing product selectivity of a single bed system and a dual-bed system.

FIG. 3 indicates that, in a dual bed reactor, in addition to a considerable reduction in the yield of methane and other light gaseous hydrocarbons, the selectivity of heavy liquid hydrocarbons significantly increases.

The effluent of the second stage is injected to the third stage of the reactor together with a syngas, $H_2$/CO ratio of which can be higher than the syngas fed to previous parts. The syngas with high $H_2$/CO ratio can be introduced to the last parts of the fixed-bed or last stages of the slurry reactors to enhance desorption, hydrogenation, and hydrogenolysis of heavy fuels to middle distillates. The number of stages can be determined based an economic feasibility.

In a series of so called "hydrogen distribution strategy" experiments, the hydrogen of the syngas was divided into four portions and equally distributed at 3 point along a fixed bed reactor, in addition to the bed inlet. In this way, composition of the syngas and its residence time change along the reactor. At the first part of the reactor, the syngas has the lowest $H_2$/CO ratio with the highest residence time that leads to low methane, high olefin and heavier hydrocarbons selectivity. Therefore, the usual high methane selectivity at the beginning of the reactor is inhibited.

Figure 4:
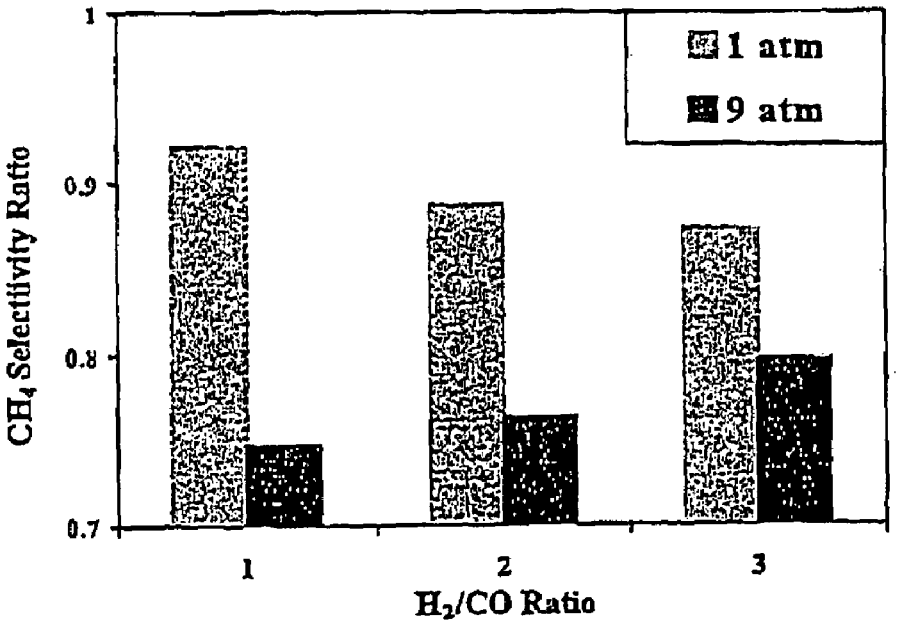
FIG. 4 is a schematic diagram showing the methane selectivity ratio at different $H_2$/CO ratios, defined as the ratio of methane selectivity when hydrogen is injected in four points along the reactor, to the methane selectivity for the feed both total hydrogen and CO to the entrance of the reactor.

As an example, FIG. 4 presents the methane selectivity ratio at different H2/CO ratios, defined as the ratio of methane selectivity when hydrogen is injected in four points along the reactor, to the methane selectivity for the feed both total hydrogen and CO to the entrance of the reactor. The methane selectivity ratio is determined by dividing the methane selectivity at hydrogen distribution strategy to that at usual co-feed strategy, in which syngas, including all CO and $H_2$, is introduced to inlet of the reactor. FIG. 4 shows that at all conditions of $H_2$/CO ratio and pressures examined, the methane selectivity ratio is lower than 1. This indicates that, by distributing hydrogen, the methane selectivity dramatically reduces. Still hydrogen distribution at higher pressures more strongly inhibits the formation of methane.

Figure 5:
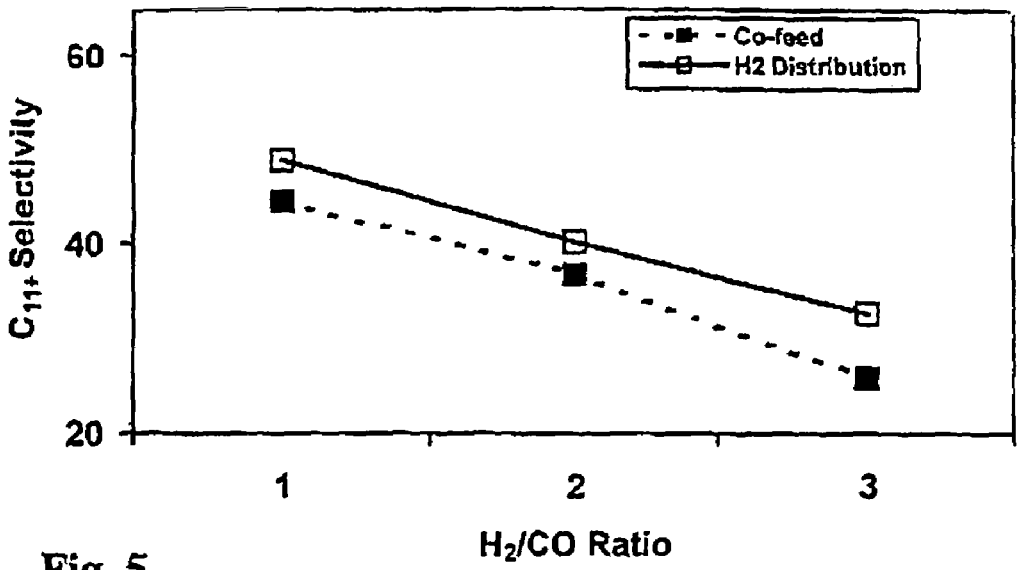
FIG. 5 is a curve showing the effects of $H_2$/CO rations on $C_{11+}$ selectivity under hydrogen distribution and Co-feed strategies.

The effects of $H_2$/CO ratios on C11+ selectivity under hydrogen distribution and Co-feed strategies is shown in FIG. 5. FIG. 5 shows that, by distributing hydrogen, the $C_{11+}$ selectivity enhances up to 26% at $H_2$/CO ratio of 3, which is a typical value for syngas produced by steam reforming of methane in gas-to-liquid processes.

Figure 6:
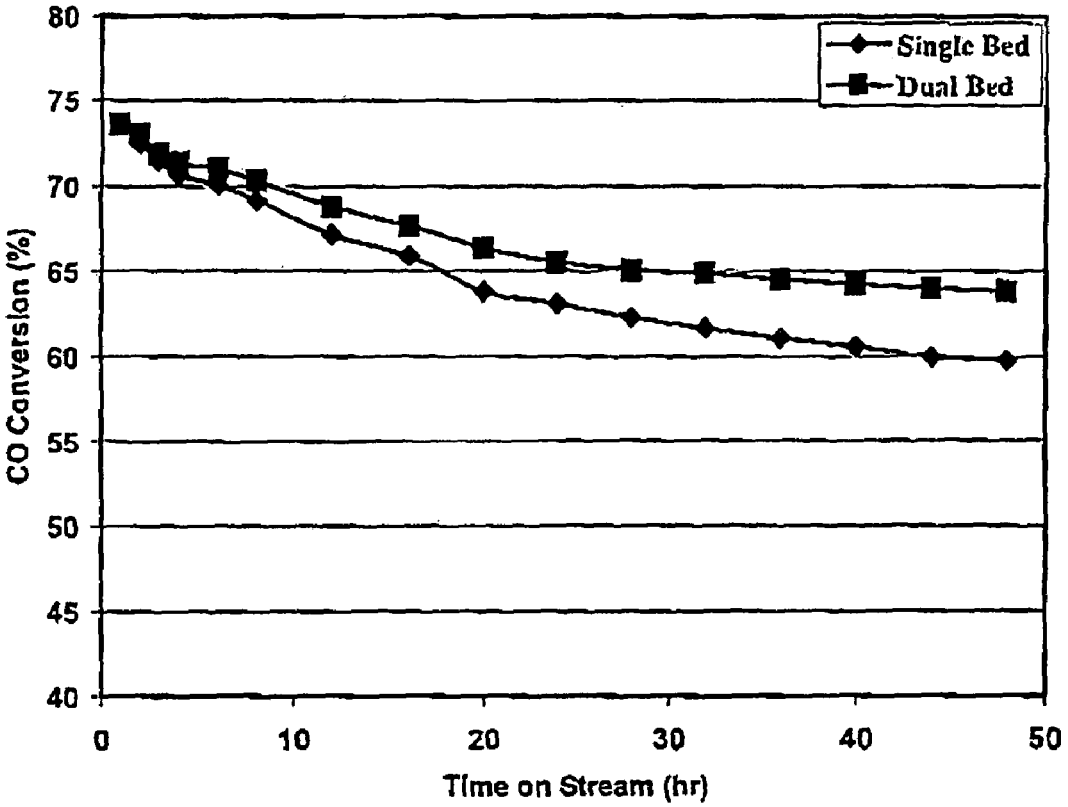
FIG. 6 is a curve showing the deactivation rate of the catalyst in the dual bed and single bed systems.

In a series of experiments, as shown in FIG. 6, Fischer-Tropsch synthesis was performed at 260° C. and 1 bar, with about 80% conversion of carbon monoxide, when water is re-moved in the mid part of a fixed bed reactor the deactivation of the catalyst, is reduced by 32%. Also the coke formation is inhibited by about 45 wt %.

Three-Stage Fischer-Tropsch Reactor

Figure 7:
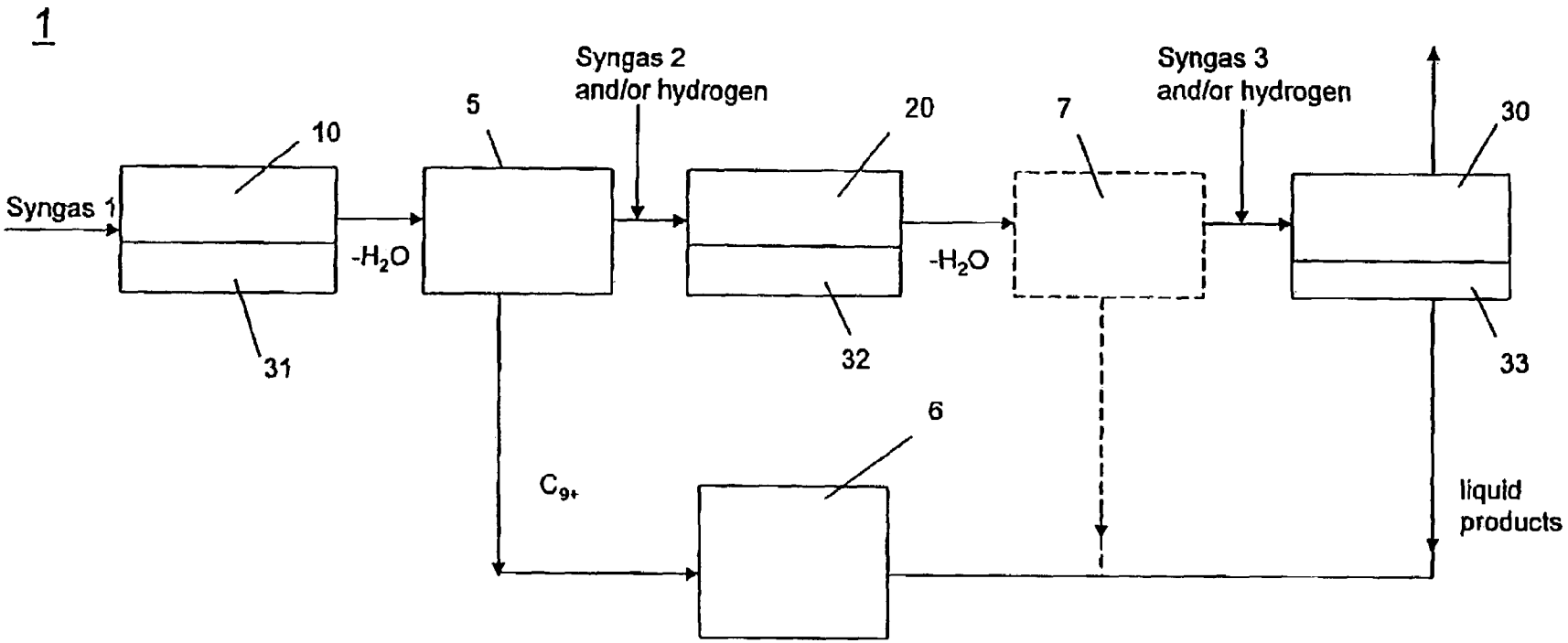
FIG. 7 is a schematic block diagram for explaining a process and a system for FT-synthesis according to the present invention.

Referring to FIG. 7 a preferred embodiment of the present invention for a multi-step Fischer-Tropsch reactor is described. As can be seen in FIG. 7, in this example the FT-reactor 1 is formed as a three-stage synthesis reactor, comprising three subsequent synthesis stages formed by the first reactor 10, the second reactor 20 and the third reactor 30. The respective reactors can be formed as fixed-bed reactors or slurry bubble column reactors.

Referring to FIG. 1, a mixture of carbon monoxide and hydrogen (syngas 1) with a hydrogen to carbon monoxide ratio between about 0.5 and 2.0 is fed to the first FT reactor 10, which comprises a first catalyst 31, as outlined above. The products are cooled, water is removed and the $C_{9+}$ fraction is isolated by distillation by the distillation device 5. The distilled $C_{9+}$ fraction can be upgraded (box 6). The $C_{1-8}$ fraction and additional syngas (syngas 2) is fed to a second stage FT reactor 20 comprising the second catalyst 32. The syngas 2 has a higher hydrogen to carbon monoxide ratio than syngas 1 and the second stage FT reactor 20 is held at a higher temperature than the first stage FT reactor 10. The products of the second stage 20 can be cooled and water and liquid hydrocarbons can be removed by device 7, which is configured similar to device 5 and operated at similar condition but at different temperatures than device 5. The isolated fraction can be upgraded (as indicated by the broken lines).

The products of the second stage 20 and a third syngas (syngas 3) are then fed to the third stage 30 comprising the third catalyst 33. As indicated by the vertical arrow, methane and short chained hydrocarbons, e.g. up to $C_4$, are separated from the products from the third stage.

The process of the present invention is practiced in continuous operation. Although the stages described herein are described in terms of a Fischer-Tropsch reaction, these stages can optionally be performed using various modifications of the literal Fischer-Tropsch process where hydrogen (or water) and carbon monoxide (or carbon dioxide) are converted to hydro-carbons (e.g., paraffins, ethers, etc.). Thus, the term Fischer-Tropsch type product or process is intended to apply to Fischer-Tropsch processes and products and the various modifications thereof and the products thereof For example, the term is intended to apply to the Kolbel-Engelhardt process typically described by the reaction:

$$3CO+H_2O \rightarrow >—CH_2 \rightarrow >2CO_2$$

The $CO_2$ product can be returned to the syngas generator and combined with methane (and some air) to form additional syngas.

What is claimed:

1. An integrated process for producing liquid fuels, the process comprising:

a) subjecting syngas with a hydrogen/carbon monoxide ratio of 0.5 to 2.0 to Fischer-Tropsch reaction conditions at pressures in the range of 10 bar and 40 bar and temperatures in the range of 180° C. and 220° C. in one of a slurry reactor and a fixed-bed reactor charged with a first catalyst, which catalyst is an alkali-promoted cobalt-based catalyst;

b) optionally removing at least one of water and heavy hydrocarbons from the product stream;

c) subjecting the product from one of step a) and step b) together with one of syngas of a hydrogen/carbon monoxide ratio higher than that of step a) and hydrogen to Fischer-Tropsch reaction conditions at pressures in the range between 10 bar and 40 bar and temperatures in the range of 200° C. and 250° C. in a slurry reactor or fixed-bed reactor charged with a second catalyst, said second catalyst being a promoted cobalt-based catalyst having a higher activity than said first catalyst;

d) optionally removing at least one of water and liquid hydrocarbons from the product stream of c); and e) subjecting the product from one of step c) and d) together with syngas to Fischer-Tropsch reaction conditions at pressures in the range between 10 bar and 40 bar and temperatures in the range of 200° C. and 250° C. in the presence of a third catalyst, said third catalyst being a promoted cobalt-based catalyst having a higher activity than at least said first catalyst.

2. The process of claim 1, wherein the first catalyst has an alpha value of 0.8 to 0.98 and said second catalyst has an alpha value of 0.80 to 0.95.

3. The process of claim 1, wherein a carbon monoxide conversion in step a) is 10% to 40% and wherein the carbon monoxide conversion in step c) is 40% to 95%.

4. The process of claim 1, wherein a heavy liquid fraction is isolated after step a) and before step c).

5. The process of claim 1, wherein the product of step a) in the $C_{2-8}$ range includes 75% olefins by weight.

6. The process of claim 1, wherein the first catalyst comprises 10% wt. to 50% wt. of cobalt, wherein the atomic ratio of the alkali metal to cobalt is 0.01 to 0.1.

7. The process of claim 6, said first catalyst further comprising 0.1% wt. to 3% wt. of noble metals.

8. The process of claim 1, wherein said second catalyst is promoted with ruthenium, said second catalyst comprising 10% wt. to 60% wt. of cobalt and 0.1% wt. to 3% wt. of ruthenium.

9. The process of claim 8, said second catalyst further comprising a lanthanide or actinide oxide in an amount of 1% to 5% by total weight of said second catalyst.

10. The process of claim 1, wherein said second catalyst and said third catalyst are identical.

11. The process of claim 1, wherein a hydrogen/carbon monoxide ratio of said syngas in step e) is higher than in step c).

12. The process of claim 1, wherein said syngas is injected during at least one of step c) and step e) at lower pressures than during step a).

13. The process of claim 1, wherein the first catalyst is reduced at temperatures in the range between 300° C. and 500° C. prior to performing step a).

* * * * *

UNITED STATES PATENT AND TRADEMARK OFFICE

CERTIFICATE OF CORRECTION

PATENT NO. : 7,226,954 B2
APPLICATION NO. : 11/242726
DATED : June 5, 2007
INVENTOR(S) : Ahmad Tavasoli et al.

It is certified that error appears in the above-identified patent and that said Letters Patent is hereby corrected as shown below:

Claim 1, Col. 11, Line 9, change "10 bar and 40 bar" to --10 bar to 40 bar--

Claim 1, Col. 11, Line 10, change "180ºC. and 220ºC." to --180ºC to 220ºC--

Claim 1, Col. 11, Line 21, change "200ºC. and 250ºC." to --200ºC to 250ºC--

Claim 1, Col. 11, Line 30, change "200ºC. and 250ºC." to --200ºC to 250ºC--

Signed and Sealed this

Twenty-seventh Day of November, 2007

JON W. DUDAS
*Director of the United States Patent and Trademark Office*